US010435233B2

(12) United States Patent
Adams et al.

(10) Patent No.: US 10,435,233 B2
(45) **Date of Patent: *Oct. 8, 2019**

(54) PARACORD DISPENSER AND ASSOCIATED METHODS

(71) Applicant: QUIKCORD INC., East Longmeadow, MA (US)

(72) Inventors: Matthew Adams, Springfield, MA (US); Matthew Austin Fioretti, East Longmeadow, MA (US)

(73) Assignee: QUIKCORD INC., East Longmeado, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/152,959

(22) Filed: Oct. 5, 2018

(65) Prior Publication Data

US 2019/0031429 A1 Jan. 31, 2019

Related U.S. Application Data

(63) Continuation of application No. 14/854,143, filed on Sep. 15, 2015, now Pat. No. 10,118,755.

(60) Provisional application No. 62/118,147, filed on Feb. 19, 2015, provisional application No. 62/117,519, filed on Feb. 18, 2015.

(51) Int. Cl.

| | |
|---|---|
| ***B65D 85/67*** | (2006.01) |
| ***A45F 5/02*** | (2006.01) |
| ***B65H 49/08*** | (2006.01) |
| ***B65H 75/36*** | (2006.01) |
| ***B65D 25/20*** | (2006.01) |
| ***B65D 47/06*** | (2006.01) |
| ***B65B 7/28*** | (2006.01) |
| *B65B 67/02* | (2006.01) |

(52) U.S. Cl.

CPC ..... *B65D 85/67* (2013.01); *A45F 5/021* (2013.01); *B65B 7/28* (2013.01); *B65D 25/20* (2013.01); *B65D 47/06* (2013.01); *B65H 49/08* (2013.01); *B65H 75/362* (2013.01); *B65B 67/02* (2013.01); *B65H 2701/35* (2013.01); *B65H 2701/356* (2013.01); *B65H 2701/533* (2013.01)

(58) Field of Classification Search

CPC ..... B65D 25/20; B65D 47/06; B65B 7/28
USPC ..... 206/389, 409
See application file for complete search history.

(56) References Cited

U.S. PATENT DOCUMENTS

| | | | | |
|---|---|---|---|---|
| 4,410,084 A * | 10/1983 | Ladner | B63B 35/815 | 206/408 |
| 5,421,457 A * | 6/1995 | Listenberger | B65D 85/04 | 174/50 |
| 2005/0145534 A1* | 7/2005 | Steeber | H01R 13/443 | 206/702 |

* cited by examiner

*Primary Examiner* — King M Chu
(74) *Attorney, Agent, or Firm* — Heslin Rothenberg Farley & Mesiti P.C.; Stephen P. Scuderi

(57) ABSTRACT

A cord dispenser includes a body having a body outer wall and an inner chamber. The inner chamber is operable to contain a length of cord, the cord having a first cord end. A retaining mechanism is rigidly affixed to the body outer wall of the dispenser. The retaining mechanism is sized to removably secure a light source. A first through-hole is disposed in the body through which the first cord end is operable to be extended and to be securely attached to the light source.

6 Claims, 12 Drawing Sheets

10
12
14
16
18
20
22
24
25
26
28
30
L
D

PARACORD DISPENSER AND ASSOCIATED METHODS

CROSS REFERENCE TO RELATED APPLICATIONS

This patent application claims the benefits of U.S. non-provisional application Ser. No. 14/854,143, filed on Sep. 15, 2015, titled Paracord Dispenser and Associated Methods, U.S. provisional application Ser. No. 62/117,519, filed on Feb. 18, 2015, titled Backstacked Paracord Dispenser and Associated Methods, and U.S. provisional application Ser. No. 62/118,147, filed on Feb. 19, 2015, titled Backstacked Paracord Dispenser and Associated Methods, all of which are incorporated herein by reference in their entirety.

FIELD OF THE INVENTION

The present invention relates to cord dispensers. More specifically, the invention relates to a backstacked paracord dispensers and associated methods of making the same.

BACKGROUND OF THE INVENTION

Paracord (also referred to as parachute cord, 550 paracord or 550 cord) is a type of lightweight nylon kernmantle rope originally used in suspension lines of parachutes. Kernmantle rope is rope which includes an interior core (or kern) that is surrounded by a woven exterior sheath designed to optimize strength, durability and flexibility. The core fibers provide the tensile strength of the rope, while the outer sheath protects the core from abrasion during use. Paracord is inexpensive, light weight, tough, durable, flexible and has a very high breaking strength relative to its small diameter.

Paracord is typically manufactured in two general varieties, i.e., an exactingly defined military specification (or mil-spec) paracord, and a commercial paracord. The mil-spec paracord meets at least the technical standard of MIL-C-5040H type III and has a rated minimum breaking strength of 550 pounds (hence the name 550 cord). Mil-spec paracord typically has a core which includes 7 to 9 removable inner yarns with each yarn made up of at least 3 strands twisted together to form the yarn.

The use of paracord is limited only by one's imagination. However, mil-spec paracord especially is used throughout the world as an essential emergency or survival tool by such personnel as military personnel, emergency medical technicians, first responders, policemen, firemen, outdoorsmen and the like.

Virtually all members of the military carry mil-spec paracord on them as an emergency tool. In military field applications the paracord is used to perform an enormous variety of emergency tasks such as fashioning a handle for a litter to carry a wounded soldier out of a battle, tying a loose bumper to a motor vehicle, making and applying a tourniquet and so much more. In each emergency situation though, when the paracord is needed, it must be ready, tangle free and easily accessible.

However, providing a container or vessel that can carry, store and dispense a length of paracord as an emergency tool in such a manner that it remains tangle free is problematic. Most survival kits will have a length of paracord in them. However there is no prior art vessel designed to store and dispense the paracord in a tangle free manner. Often times a user of the paracord must spend precious time during an emergency situation unraveling a tangled bundle of the paracord that developed over time as the user carried the survival kit around.

An additional problem is that a user involved in an emergency situation will often be required to cut a specific length of paracord rather than use the entire length of paracord in the survival kit. Looking for a cutting tool appropriate to efficiently cut the tough paracord can also waste valuable time.

Moreover, the survival kit is regularly subjected to rough handling and high impacts as the personnel involved in an emergency situation must work in hazardous environments or travel over rough terrain. The survival kit and paracord may even be submerged in water during an emergency water rescue event. This frequent rough handling and exposure to hazardous environments can problematically serve to further tangle the paracord or damage any vessel containing the paracord such that the vessel will not dispense the paracord efficiently.

Being able to signal for rescue is very important in a survival situation. A well know signaling technique involves fastening a length of paracord to a luminescent chemical light (or glow stick) device and whirling the chemical light overhead to provide a glowing circular signal which can be easily seen at night or in poor visibility situations. This signaling technique (or method) is traditionally called a Buzz-Saw.

For purposes of clarity, a chemical light is a self-contained, short-term light-source. It generally includes a translucent plastic tube, about one half (½) of a foot long and about one half (½) to three quarters (¾) of an inch in diameter. The chemical light contains chemical substances in isolated compartments within the tube. The chemical substances can be combined by bending the chemical light tube to crack open the compartments. Once combined, the chemicals substances produce light through chemiluminescence. The chemical light does not require an external energy source, can only be used once and cannot be turned off. The chemical substances may be varied to produce different types and colors of light including infrared light, which is typically used in military grade chemical lights. One such manufacturer of military grade chemical lights is Cyalume Technologies, Inc. (www.cyalume.com) having executive offices located in Fort Lauderdale, Fla. and manufacturing facilities located in West Springfield, Mass., USA.

The Buzz-Saw signaling technique can be particularly critical in military combat situations where the evacuee is a wounded soldier. Military personnel around the world are regularly issued an infrared chemical light in their survival kits, along with their paracord, for just this purpose. The infrared light from the chemical light cannot be easily seen with the naked eyes of an enemy combatant, but can be seen by trained emergency personnel wearing night vision equipment.

However, fastening the paracord to the chemical light can take precious time. Additionally, the soldier must now find both the paracord and the chemical light in their survival kit, which also takes up time. Moreover, rough handling of the chemical light can bend an unprotected chemical light, causing it to activate and burn out its light source long before it is required. This can be particularly problematic with an infrared chemical light since the soldier deploying the Buzz-Saw technique may not be able to see the infrared light of the activated chemical light without special equipment and, therefore, may not know that the chemical light is defective.

Accordingly, there is a need for an inexpensive paracord dispenser system which allows efficient, tangle free access to the paracord. Additionally, there is a need for the dispenser system to be rugged and to be able to withstand a substantial impact without losing its functionality. Moreover, there is a need for the dispenser system to enable the user to easily measure off and cut a length of paracord that is appropriate for any particular emergency situation.

Additionally, there is a particular need for a paracord dispenser system that can both protect paracord and a chemical light simultaneously in order to reliably and quickly perform the Buzz-Saw technique in an emergency evacuation situation. There is also a need to decrease the amount of time required to find and assemble the paracord and chemical light in order to perform the Buzz-Saw signal method.

SUMMARY OF THE INVENTION

The present invention offers advantages and alternatives over the prior art by providing a dispenser system that allows efficient tangle free access to paracord for general purpose applications and can withstand substantial impacts during rough handling without losing functionality. Additionally the present invention provides a dispenser that can both protect paracord and a chemical light simultaneously in order to reliably and quickly perform the Buzz-Saw signaling technique during an emergency situation.

These and other advantages are accomplished in exemplary embodiments of the invention by providing a backstacked paracord dispenser which includes a body and a lid. The body having a closed bottom and a first sidewall integrally connected to the bottom and extending upward therefrom for a predetermined length L. The lid having a closed top and a second sidewall integrally connected to the top and extending downward therefrom, the second sidewall sized to securely fit to the body. A through-hole is disposed in the top. A length of paracord is disposed in the body and has one end extend through the through-hole. The paracord was backstacked into the body in sections that were allowed to fall naturally and entirely into the body, each section extended outward from the body for a length that is no greater than twice the length L of the body's first side wall prior to being backstacked into the body.

In an alternative embodiment, a method of backstacking a paracord dispenser is presented. The dispenser includes a body having a closed bottom and a first sidewall integrally connected to the bottom and extending upward therefrom for a predetermined length L. The dispenser also includes a lid having a closed top and a second sidewall integrally connected to the top and extending downward therefrom. The second sidewall is sized to securely fit to the body. A through-hole is disposed in the top of the lid. The method includes the steps of: inserting one end of a paracord into the body; repeatedly reaching back for a section of paracord that extends outward from the body for a length of no greater than twice the length L of the body's first side wall; allowing each section to fall naturally and entirely into the body until the entire length of paracord is disposed in the body; extending another end of the paracord through the through-hole in the lid of the dispenser; and securely fastening the lid to the body.

In another alternative embodiment a cord dispenser includes a body having an inner chamber containing a length of cord, the cord having first and second cord ends. The cord dispenser also includes a first through-hole through which the first cord end is extended and through which the cord is dispensed for use in any general purpose application. A chemical light retaining mechanism is rigidly affixed to the body of the dispenser, the retaining mechanism being sized to removably secure and protect a chemical light from inadvertent activation during handling of the cord dispenser. The dispenser also includes a second through-hole through which the second cord end is extended and is securely attached to the chemical light. Wherein the chemical light can be removed from the retaining mechanism and used with the attached cord to provide a Buzz-Saw signal.

In another alternative embodiment a cord dispenser includes a body having an inner chamber containing a length of cord, the cord having a cord end. A chemical light retaining mechanism is rigidly affixed to the body of the dispenser, the retaining mechanism being sized to removably secure and protect a chemical light from inadvertent activation during handling of the cord dispenser. The dispenser also includes a through-hole through which the cord end is extended and securely attached to the chemical light. Wherein the chemical light can be removed from the retaining mechanism and used with the attached cord to provide a Buzz-Saw signal.

BRIEF DESCRIPTION OF THE DRAWINGS

The invention will be more fully understood from the following detailed description taken in conjunction with the accompanying drawings, in which.

DETAILED DESCRIPTION

Certain exemplary embodiments will now be described to provide an overall understanding of the principles of the structure, function, manufacture, and use of the methods, systems, and devices disclosed herein. One or more examples of these embodiments are illustrated in the accompanying drawings. Those skilled in the art will understand that the methods, systems, and devices specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention.

FIGS. 1-7 illustrate various exemplary embodiments of a backstacked paracord dispenser 10 for dispensing a length of backstacked paracord in a tangle free manner in accordance with the present invention.

Figures 1, 2:
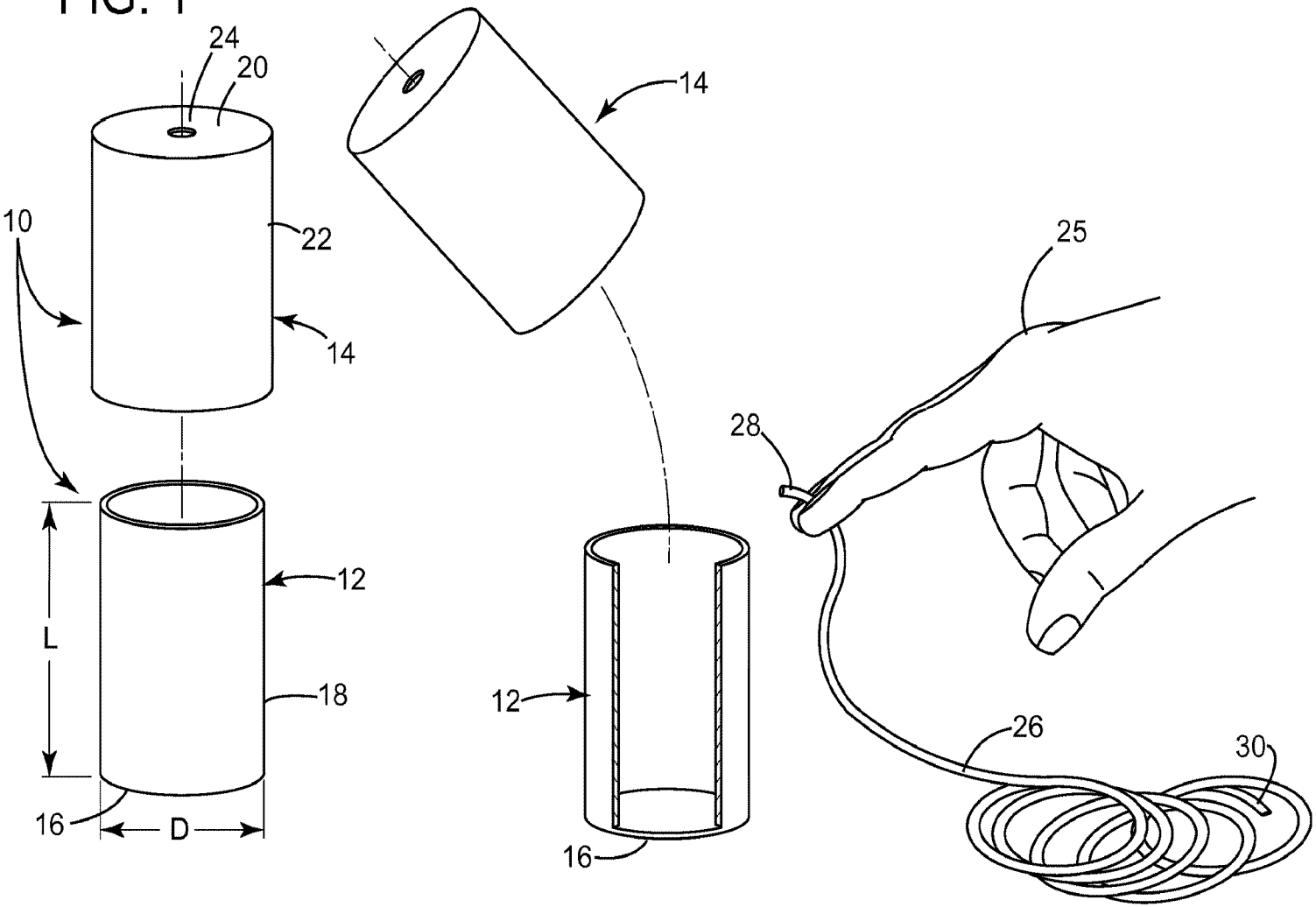
FIG. 1 is a perspective view of an exemplary embodiment of a backstacked paracord dispenser in accordance with the present invention.
FIG. 2 is a perspective cutaway view of the paracord dispenser of FIG. 1 wherein a backstacking method is beginning to be employed to backstack a length of paracord into the dispenser.

Referring to FIG. 1, the backstacked dispenser 10 includes a body (or container) 12 and a lid 14 for engagement with the body 12. In this particular illustration, the lid 14 is disengaged from the body 12 and can be assembled thereon.

The body 12 is generally tube shaped and has a closed bottom 16 having a diameter D, wherein the closed bottom 16 is integrally connected to a generally cylindrical first sidewall 18 extending upwardly from the bottom 16 for a length L. The closed bottom 16 and first sidewall 18 define an interior volume (or chamber) that is sized to contain a length of backstacked paracord.

Body 12 can be composed of, or manufactured from, any number of materials, but is preferably composed of a durable, light weight plastic, such as a polycarbonate, that can be easily manufactured (for example through injection molding), can withstand frequent impacts and is water resistant. Alternatively, the body 12 may be manufactured, at least in part, of a flexible rubber, leather or similar material, such that the body will collapse or bend when subjected to an impact, but will flex back to its generally original shape thereafter.

One skilled in the art would recognize that the paracord dispenser 10 does not necessarily have to be generally cylindrical in shape. By way of example, the dispenser 10 may be more box shaped wherein the bottom 16 is generally rectangular and the first sidewall 18 includes four sections extending upwards from each straight edge of the bottom's rectangular perimeter.

Lid 14 has a closed top 20, which is integrally connected to a generally cylindrical second sidewall 22 extending downwardly from the top 20 and running along the entire perimeter of the top 20. The lid 14 can be composed of any number of materials, but is preferably composed of materials similar to the body 12. For example the lid may be composed of a plastic polycarbonate such that it is formed by means of an injection molding process to have inside dimensions which fit over the outer diameter D of body 12.

The top 20 of lid 14 also contains a through-hole 24 located generally in the center of top 20. Through-hole 24 is sized to allow a length of paracord to extend and be dispensed therethrough. Alternatively, the through-hole 24 may be composed of a plurality of intersecting slits (such as straw slits) in the lid 14, which allow the paracord to extend through and be dispensed with little resistance, but also holds the paracord in place and prevents the paracord from retracting back into the body 12.

The lid 14 may be designed to fasten securely to the body 12 in any number of ways. For example, the second sidewall 22 of lid 14 may contain female threads designed to screw onto male threads in the first sidewall 18 of body 12. Alternatively, the lid 14 and body 12 may simply slide together in a friction fit or may contain clasps to securely hold the lid 14 to the body 12.

One skilled in the art would recognize that even though the second sidewall 22 of the lid 14 in this exemplary embodiment is illustrated as being substantially the same length L as the first sidewall 18 of the body 12, the second sidewall 22 can be substantially shorter than the first sidewall 18. That is the lid 14 may securely fasten to the body 12 while covering only a small portion of the body 12. In fact, the second sidewall 22 of the lid 14 may be designed to fasten, and sized to fit, securely into the inside dimensions of the body (for example, via male threads on the outside surface of sidewall 22 and corresponding mating female threads on the inside surface of sidewall 18), thus covering virtually no outside portion of the first sidewall 18 at all.

Referring to FIG. 2, a manufacturer 25 is preparing to backstack a length of paracord 26 into body 12 using a backstacking technique or method. As illustrated in FIG. 2, the backstacking process begins by placing one end 28 of paracord 26 into the bottom of body 12.

Figure 3:
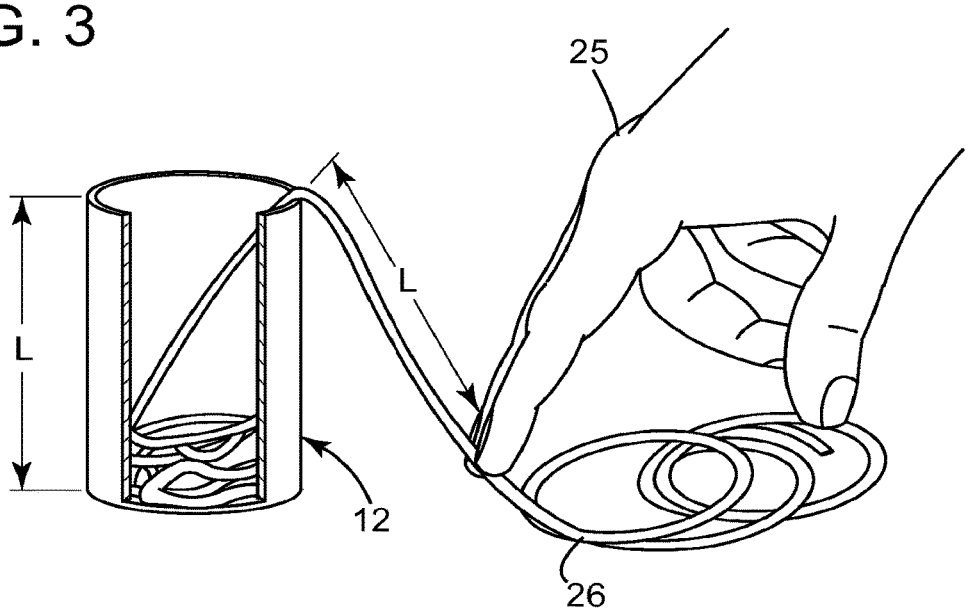
FIG. 3 is a perspective cutaway view of the paracord dispenser of FIG. 1, wherein the paracord is partially backstacked into the dispenser via the backstacking method.

Referring to FIG. 3, once the end 28 of the paracord 26 has been placed into the body 12, the manufacturer 25 then repeatedly reaches back for a section of cord 26 that is extending outside of the body 12 equal to the length L of the body 12 or less. Though is it most preferred that the section of cord extend outside of the body for a length no greater than L, the backstacking technique will work if the section of cord extended back a distance of 2 L or less and more preferably for a distance of 1.5 L or less. This is because each section of cord 26 must be allowed to fall naturally and completely onto the sections of paracord that have already been backstacked into the body 12. If the length of the section were too long (i.e., greater than 2 L in length), the section would tend to fall outside of the body 12 and hang as a loop on the outside of the body 12, which could cause the paracord to get tangled when being dispensed.

Figure 4:
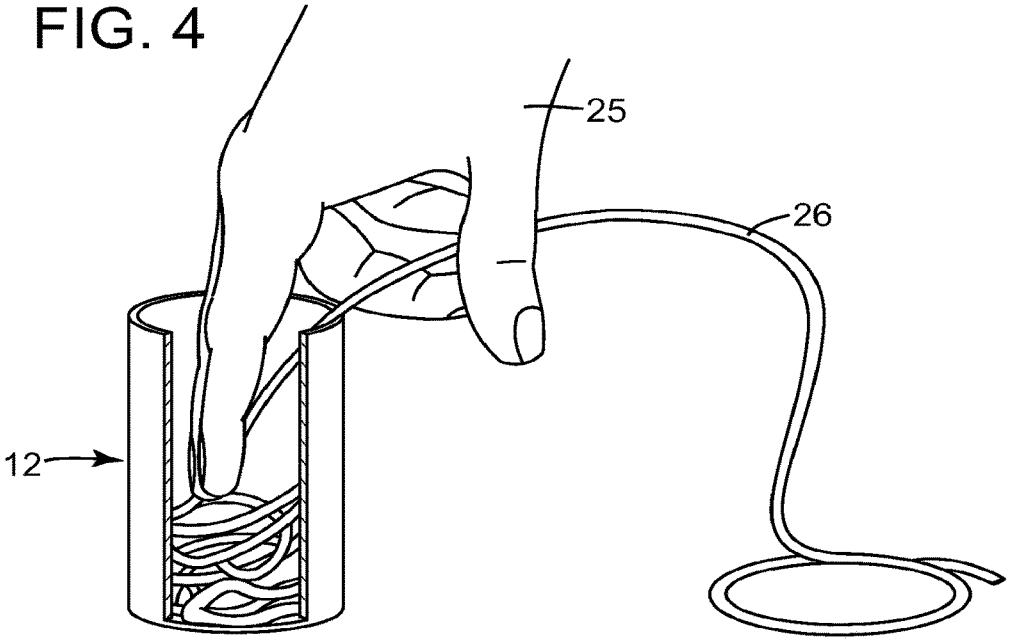
FIG. 4 is a perspective cutaway view of the paracord dispenser of FIG. 1, wherein the paracord is further backstacked into the dispenser via the further application of the backstaking method.

Referring to FIG. 4, the manufacturer 25 has almost completed the backstacking process by letting each section of paracord fall naturally onto the previously backstacked sections of paracord. The manufacturer will continue this process until the entire length of paracord is packed, or backstacked, into the body 12.

One skilled in the art would understand that even though the manufacturer 25 is represented by an illustrated hand, any number of more automated techniques can be employed by manufacturer 25 to accomplish the same backstacking technique. For example, robotics may be utilized by the manufacturer 25 for high production backstacking of the bodies 12 on a fully automated or semi-automated assembly line.

Figure 5:
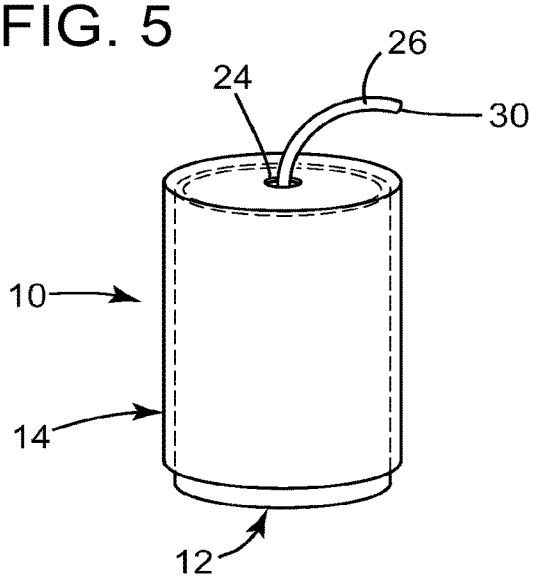
FIG. 5 is a perspective view of the paracord dispenser of FIG. 1 fully assembled, wherein the paracord has been fully backstacked into the dispenser via the backstacking method.

Referring to FIG. 5, the backstacked paracord dispenser 10 is fully assembled with lid 14 securely over body 12. The other end 30 of paracord 26 now extends outwardly from through-hole 24.

In use, backstacking the paracord 26 into body 12 in this manner ensures that the fully assembled dispenser 10 will dispense any length of paracord 26 quickly and tangle free. Additionally, since the paracord 26 has been backstacked into the dispenser 10, the backstacked dispenser 10 will keep the paracord 26 tangle free during virtually any amount of rough handling or during exposure to virtually any hazardous environment.

Figure 6:
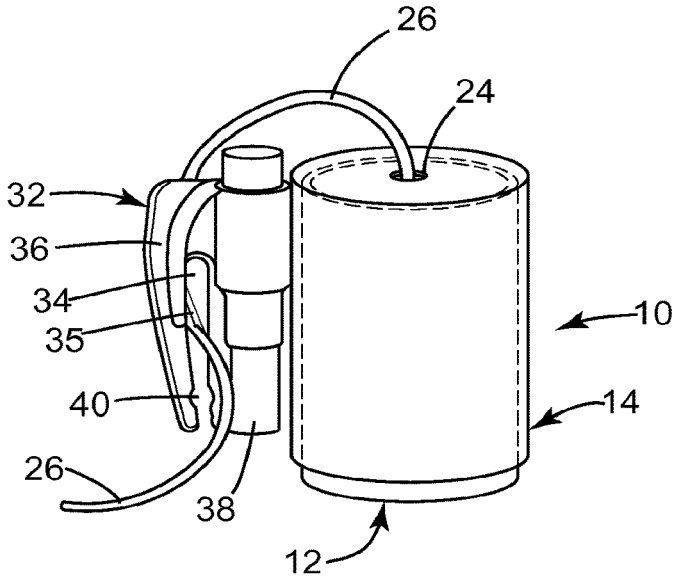
FIG. 6 is a perspective view of the paracord dispenser of FIG. 5 with a cutting device integrally mounted to the dispenser.

Referring to FIG. 6, the dispenser 10 has a cutting device 32 integrally mounted to the dispenser 10. In this exemplary embodiment the cutting device 32 is mounted to the lid 14 of the dispenser 10, but one skilled in the art would recognize that the cutting device could also be designed to mount to the body 12 as well. One would also recognize that any number or other cutting device embodiments may be mounted to the dispenser 10 other than the one described in this particular exemplary embodiment.

The cutting device 32 includes a blade 34 with a downwardly pointing knife edge 35. The blade 34 is surrounded on three sides by the combination of a handle 36 and a body 38, the body being mounted to the lid 14. A channel 40 is formed by the handle 36 and body 38 which opens downward to protect a user from getting cut while using the cutting device 32. The channel 40 is sized to receive a diameter of the paracord 26 such that a user can slide the paracord 26 against the knife edge 35 of the blade 34 to safely and efficiently cut a desired length of the paracord 26.

Figure 7:
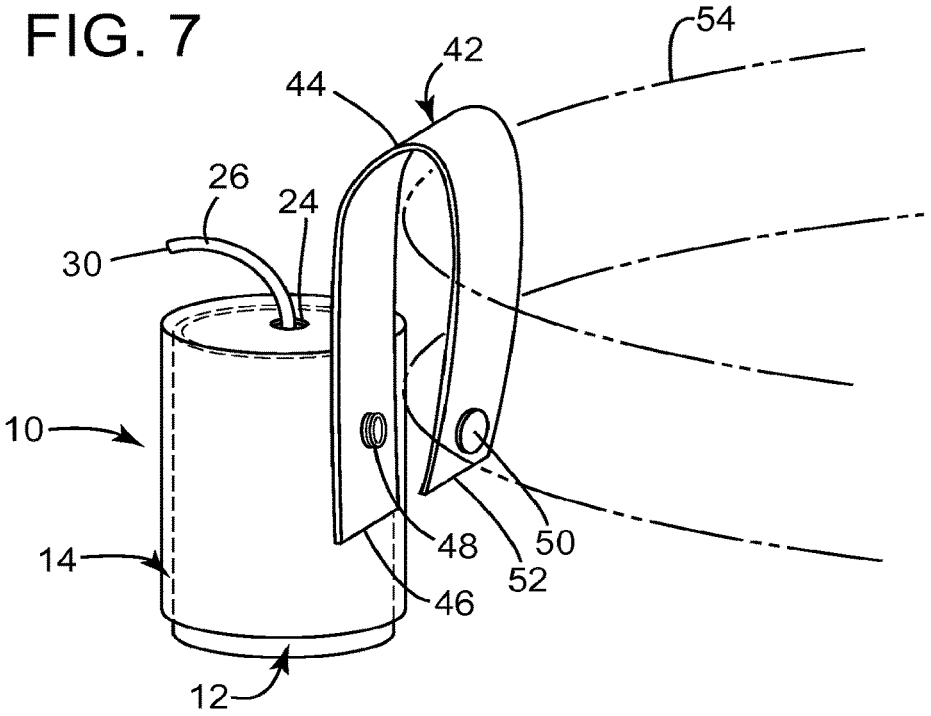
FIG. 7 is a perspective view of the paracord dispenser of FIG. 5 with an attachment device integrally mounted to the dispenser.

Referring to FIG. 7, an attachment device 42 is integrally mounted to the dispenser 10. In this exemplary embodiment the attachment device 42 is mounted to the lid 14 of the dispenser, but one skilled in the art would recognize that the attachment device 42 could also be designed to mount to the body 12 as well.

The attachment device 42 includes a strap 44 which is integrally mounted to the lid 14 at an anchored end 46. A male snap fastener 48 is riveted to the strap 44 proximate the anchored end 46. A female snap fastener 50 is also riveted to the strap 44 proximate a distal end 52 of the strap 44. The strap 44 has a length sized to loop over an article of a user's clothing or gear, such as a belt 54, as the male 48 and female 50 snap fasteners mate securely together to hold the dispenser 10 thereon.

One skilled in the art would recognize that any number or other attachment device embodiments may be mounted to the dispenser 10 other than the one described in this particular exemplary embodiment. For example, the attachment device may be a pair of straps compatible with a MOLLE (Modular Lightweight Load-carrying Equipment) type system, such as the type described in U.S. Pat. No. 8,438,811 and frequently used by the US military. Additionally, the attachment device could be a D-ring system which is also sized to attach to the belt 54.

FIGS. 8-17 illustrate various exemplary embodiments of a dual output paracord dispenser 100 for dispensing a length of paracord in a tangle free manner from a first through-hole output and for rapidly and reliably enabling the deployment of a Buzz-Saw signaling technique from a second through-hole output in accordance with the present invention.

Figure 8:
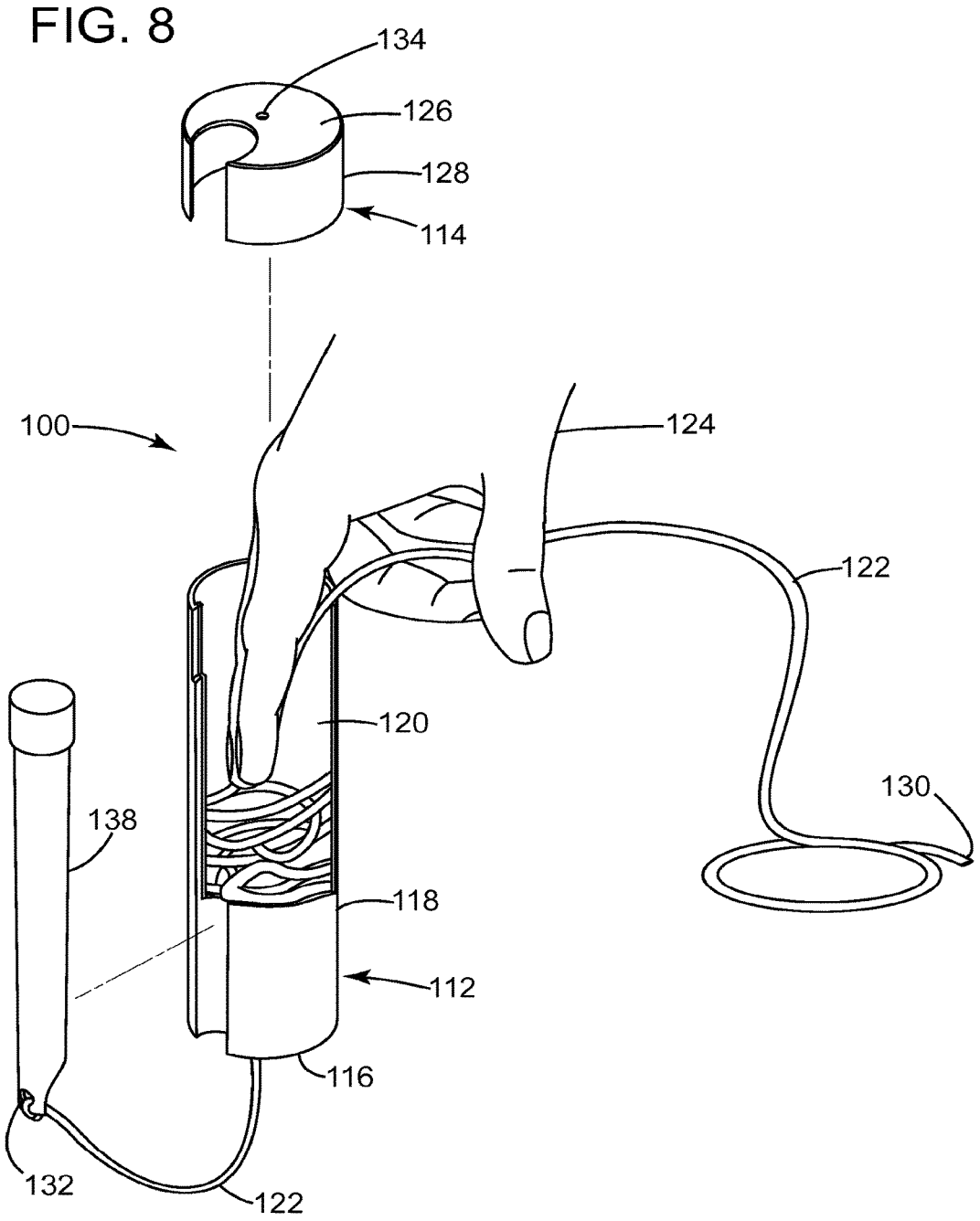
FIG. 8 is an exploded, partially cutaway, perspective view of an exemplary embodiment of a dual output paracord dispenser in accordance with the present invention.

Referring to FIG. 8, a dual output paracord dispenser 100 includes a body 112 and a lid 114 for engagement with the body 112. In this particular illustration, the lid 114 is shown disengaged from the body 112 during an assembly process and will be assembled onto the body 112.

The body 112 is generally tube shaped and has a closed bottom 116 (best seen in FIG. 14), wherein the closed bottom 116 is integrally connected to a generally cylindrical body sidewall 118 extending upwardly from the bottom 116 for a length L. The closed bottom 116 and body sidewall 118 define an inner chamber 120 that is sized to contain a length of paracord 122 which, in this illustration, is shown being backstacked into the chamber 120 by a manufacturer 124.

The lid 114 has a closed top 126, which is integrally connected to a generally cylindrical lid sidewall 128 extending downwardly from the top 126 and running along the entire perimeter of the top 126. The lid 114 is sized to fit securely to the body 112 to form the assembled dispenser 100.

Figure 9:
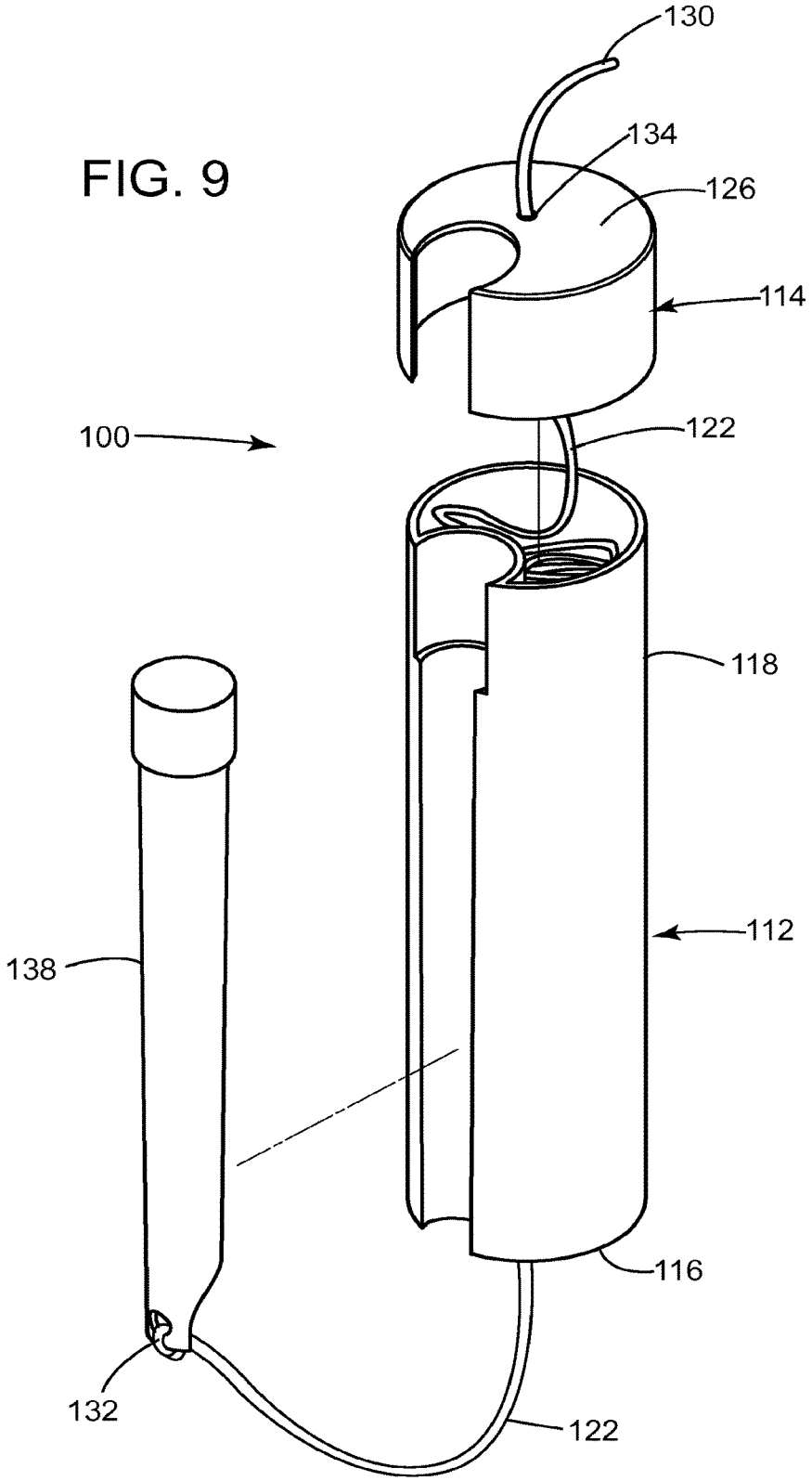
FIG. 9 is an exploded, perspective view of the dual output paracord dispenser of FIG. 8.

Referring to FIG. 9, which illustrates the dispenser 100 having the paracord 122 fully backstacked within chamber 120 and the lid 114 disengaged from the body 112. Paracord 122 has a first paracord end 130 and a second paracord end 132. The first end 130 extends through a first through-hole 134, which is disposed generally in the center of the top 126 of the lid 114. The second end 132 extends through a second through-hole 136 (best seen in FIG. 14), which is disposed generally in the center of the bottom 116 of the body 112. The second end 132 of paracord 122 is securely attached to the bottom tab of a chemical light 138.

Even though the first and second through-holes 134 and 136 are located at the top and bottom of dispenser 100, one skilled in the art would recognize that the through-holes may be disposed in other locations on dispenser 100. For example the first and second through-holes 134 and 136 may be located on upper and lower portions of the body sidewall 118 respectively.

During operation, the paracord 122, which is dispensed through the first through-hole 134, can be used for any general purpose application as discussed earlier herein. However, the paracord 122 which is dispensed through the second through-hole 136, along with the attached chemical light 138, is dedicated to providing a Buzz-Saw signal, as will be discussed in further detail herein when referring to FIG. 15.

Figure 10:
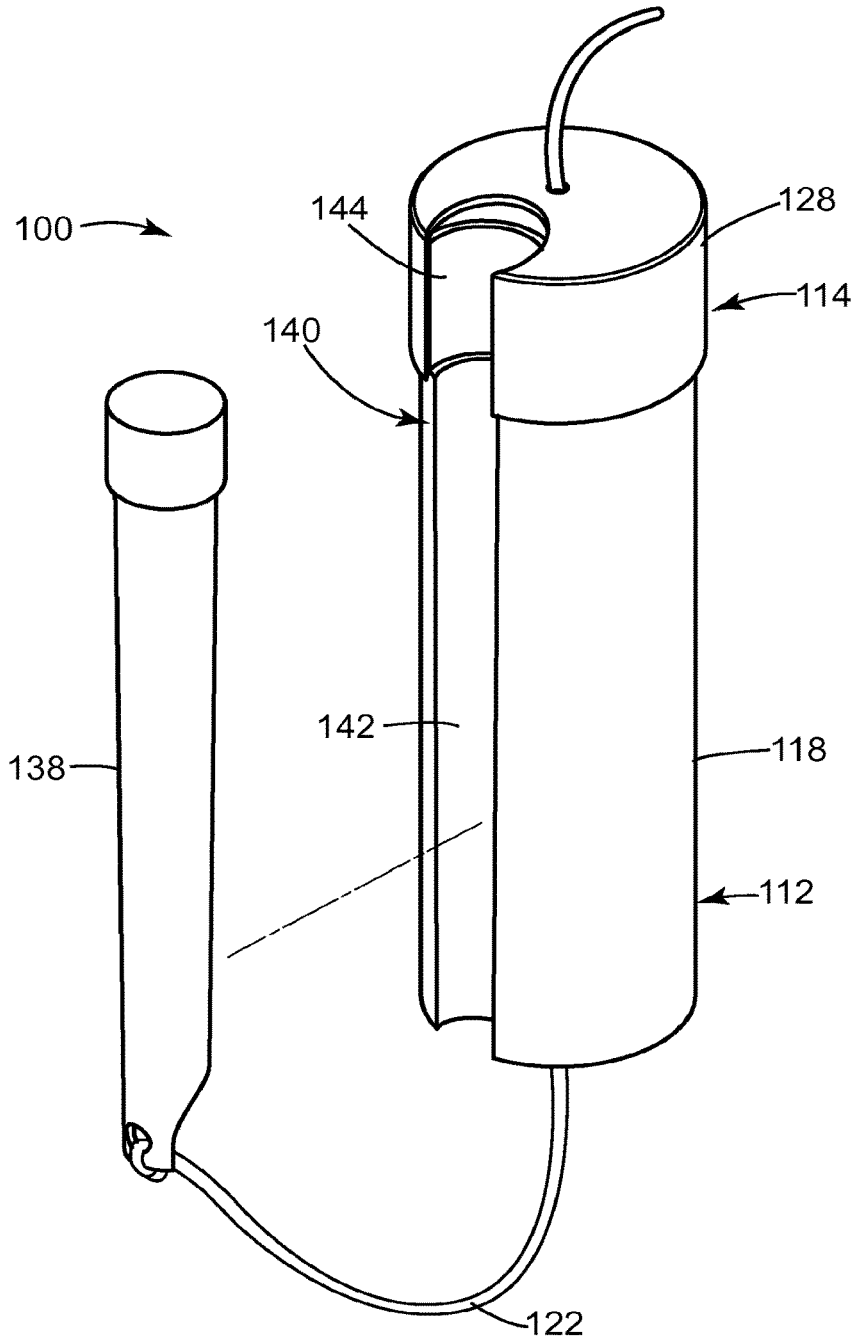
FIG. 10 is an exploded, perspective view of the dual output paracord dispenser of FIG. 8.

Referring to FIG. 10, a chemical light retaining mechanism 140 is rigidly affixed to the body 112 and lid 114 of the dispenser 100. The retaining mechanism 140 is sized to removably secure and protect chemical light 138 from inadvertent activation during handling of the paracord dispenser 100. The chemical light 138 in this illustration is shown as being disengaged from the retaining mechanism 140.

In this embodiment, the retaining mechanism 140 includes a crescent shaped tapered channel integrally formed into the body 112 and lid 114 of the dispenser 100. A first portion 142 of the crescent shaped channel retaining mechanism 140 is integrally formed into the body sidewall 118 and extends longitudinally upward along the body sidewall 118. A second portion 144 of the crescent shaped channel 140 is integrally formed into the lid sidewall 128, which extends longitudinally downward along the lid sidewall 128. When the body 112 and lid 114 are assembled to form dispenser 100, the first and second portions 142 and 144 respectively align to form the entire crescent shaped channel retaining mechanism 140 in the dispenser 100.

Figure 11:
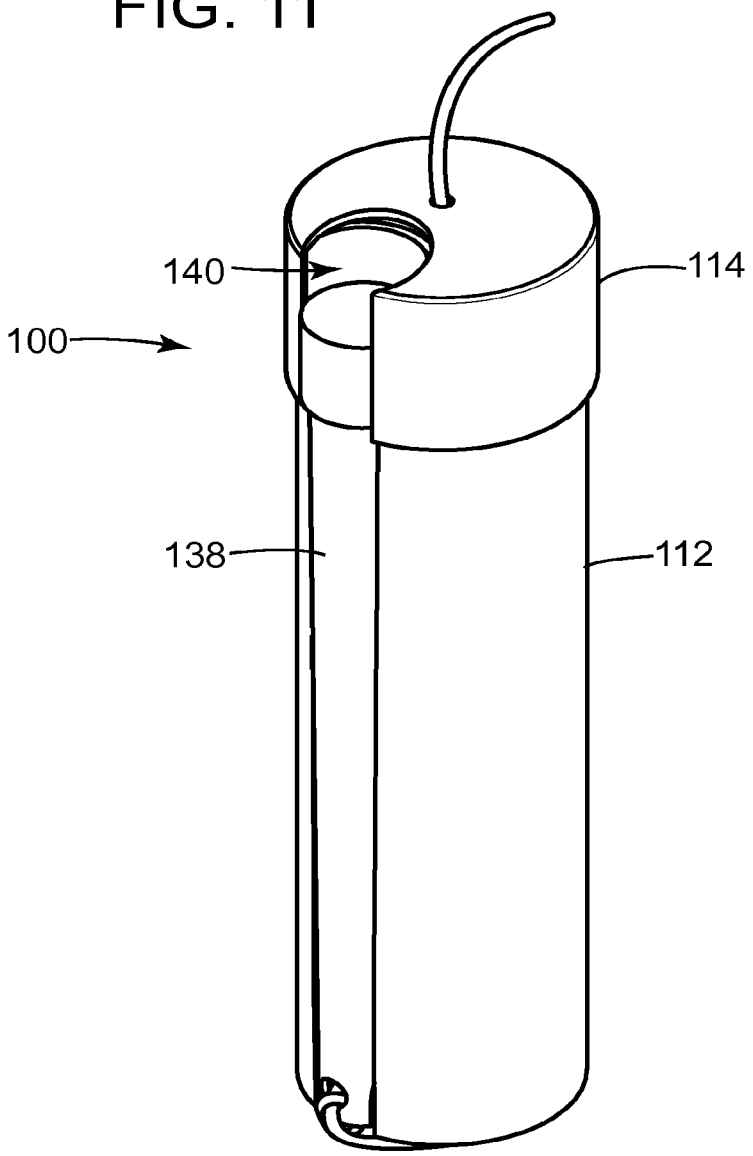
FIG. 11 is a perspective view of the dual output paracord dispenser of FIG. 8.

Referring to FIG. 11, which illustrates chemical light 138 engaged with crescent shaped channel 140. Crescent shaped channel 140 is sized to receive and secure chemical light 138 in snap-fit fashion. In order to facilitate a snap-fit engagement between chemical light 138 and crescent shaped channel 140, the body 112 and lid 114 are preferably manufactured from a resilient material, such as a light weight polycarbonate plastic. Therefore, as the slightly larger diameter of chemical light 138 is pressed against the slightly smaller opening in channel 140, the opposing edges of the crescent will be forced apart until the opening is large enough to allow the diameter of the chemical light 138 to pass through. Once the diameter of chemical light 138 has cleared the edges of channel 140, the crescent shaped channel 140 will flex back to its generally original shape, snuggly holding chemical light 138 within channel 140. Additionally, the channel is tapered (best seen in FIGS. 12, 13 and 14) such that the diameter of the crescent channel 140 is larger at the top of the dispenser 100 than it is at the bottom. This taper of channel 140 further conforms to the tapered shape of the chemical light 138 and further prevents the chemical light 138 from sliding out of the bottom of the channel 140 when engaged therein.

Figure 12:
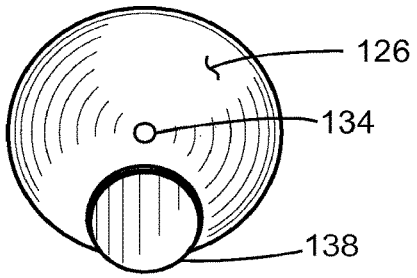
FIG. 12 is a top view of the paracord dispenser of FIG. 8.
Figure 13:
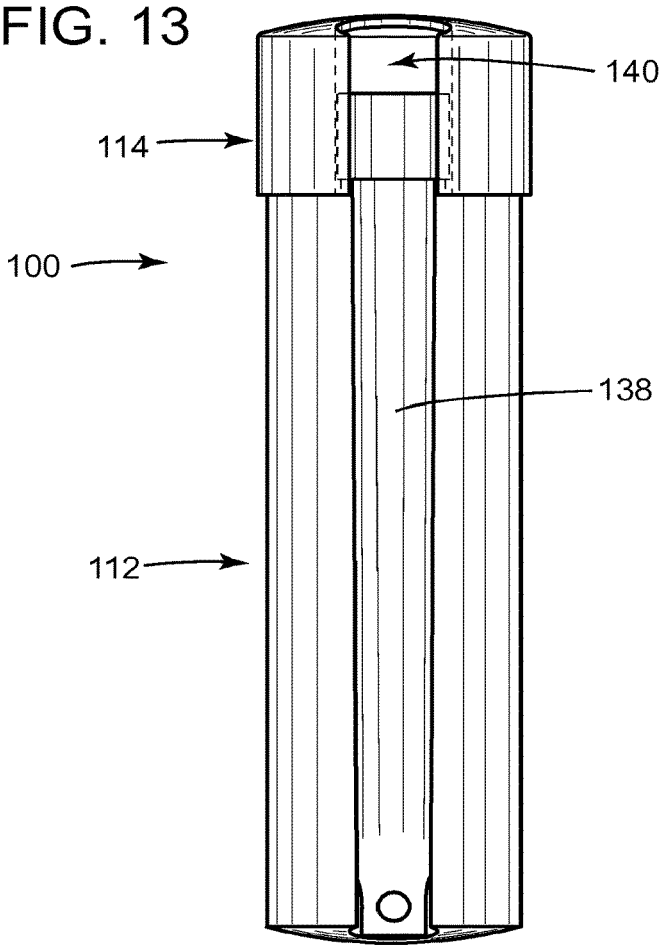
FIG. 13 is a side view of the paracord dispenser of FIG. 8.
Figure 14:
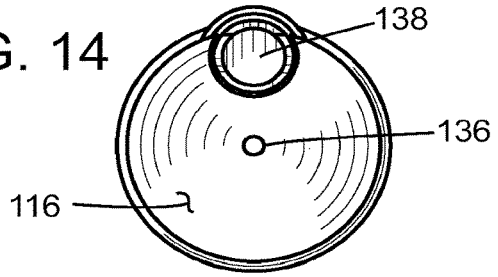
FIG. 14 is a bottom view of the paracord dispenser of FIG. 8.

FIGS. 12, 13 and 14 illustrate top, side and bottom views respectively of the chemical light 138 fully engaged with the chemical light retaining mechanism 140. In this embodiment, the crescent shaped channel 140 is formed to have a length that is equal to or greater than the length of the chemical light 138 for maximum protection against damage to the chemical light 138 during rough handling of the dispenser 100. Additionally, the crescent shaped channel 140 is deep enough so that when the chemical light 138 is fully engaged, only a small portion of the chemical light 138 is exposed. Accordingly, the geometry of the crescent shaped channel 140 virtually assures that the chemical light will be protected from damaging blows, bending and inadvertent activation of its chemiluminescence.

Even though the chemical light retaining mechanism 140 is shown in these embodiments as a crescent shaped channel, integrally formed into the body 112 and lid 114 of the dispenser 100, one skilled in the art will recognize that the retaining mechanism 140 may have different designs. For example, the retaining mechanism 140 may be attached to the side of the dispenser with rivets, rather than formed into the body and lid walls. Additionally, straps may be used to retain the chemical light 138 within the retaining mechanism 140. Alternatively, the channel 140 may not be crescent shaped and may be sized for a frictional interference or press fit rather than a snap fit. In any design, however, the retaining mechanism 140 must function to removably secure and protect the chemical light 138 from inadvertent activation during handling of the paracord dispenser 100.

Figure 15:
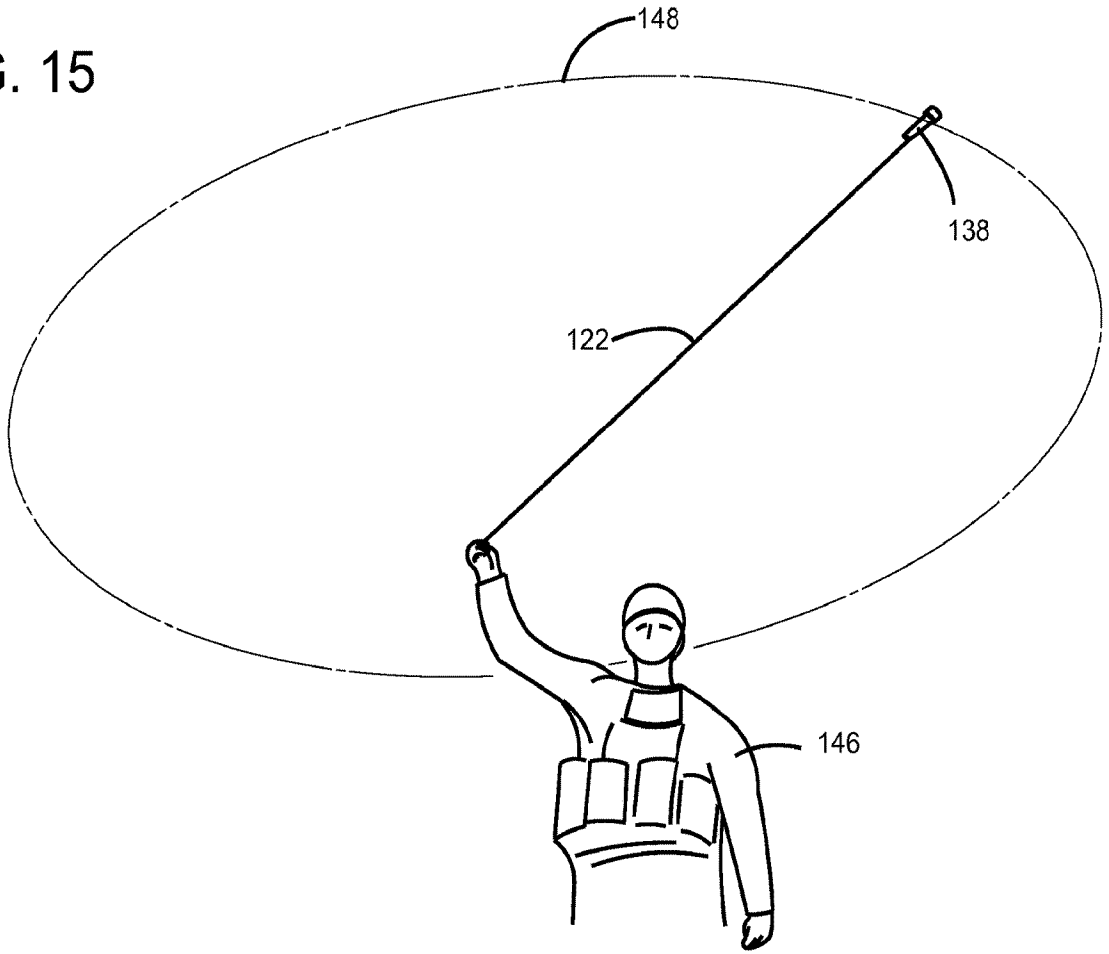
FIG. 15 is a perspective view of an operator deploying a Buzz-Saw signal in accordance with the present invention.

Referring to FIG. 15, an operator 146, such as a solder, has removed the chemical light 138 from its retaining mechanism 140, and is shown deploying the Buzz-Saw signaling technique to produce a Buzz-Saw signal 148. To do this, a length of paracord 122, typically about 3 feet long, is dispensed from the second through-hole 136 of dispenser 100. The pre-attached chemical light 138 is then bent to activate its light source and whirled overhead to create the Buzz-Saw signal 148.

There are several synergistic advantages that come from a paracord dispenser system 100 that can both protect paracord and chemical light simultaneously from damage during handling. First, reliability is increased as damage or inadvertent activation of the chemical light is virtually eliminated. Second, speed of deployment is also increased since an operator no longer has to search for the paracord and chemical light separately, and the chemical light is already attached to an end of the paracord. Third, versatility is increased since the paracord dispenser can be used reliably for a variety of general purpose applications in addition to the critical Buzz-Saw signaling technique.

It is also important to note that backstacking the paracord 122 into the dispenser 100, not only prevents the paracord from becoming tangled during rough handling, it also synergistically enables the dispenser 100 to dispense the paracord 122 from either end 130, 132 of the paracord 122. That is, there are only a limited number of methods of packing the paracord 122 into the inner chamber 120 of the dispenser 100, which will enable later extraction of either end 130, 132 of the paracord 122 for such a dual output dispenser system 100. For example, wrapping the paracord on a spool disposed in the chamber 120 of dispenser 100 will only allow one end 130 of the paracord 122 to be extracted during operation. This is because the other end 132 of the paracord 122 will be tightly bound to the spool by several layers of paracord.

One other method of packaging the paracord 122 into dispenser 100 for dual output operation would be to wrap two separate lengths of paracord 122, that is a first paracord length and a second paracord length, around two distinct sections of at least one spool. The first paracord length would have the first end 130 and would extend through the first through-hole 134 for general purpose applications. The second paracord length would have the second end 132 and would extend through the second through-hole 136 to attach to the chemical light 138 for applying the Buzz-Saw signaling technique. Since the two lengths are on two separate sections of spool, they would not interfere with each other's deployment or operation.

Figure 16:
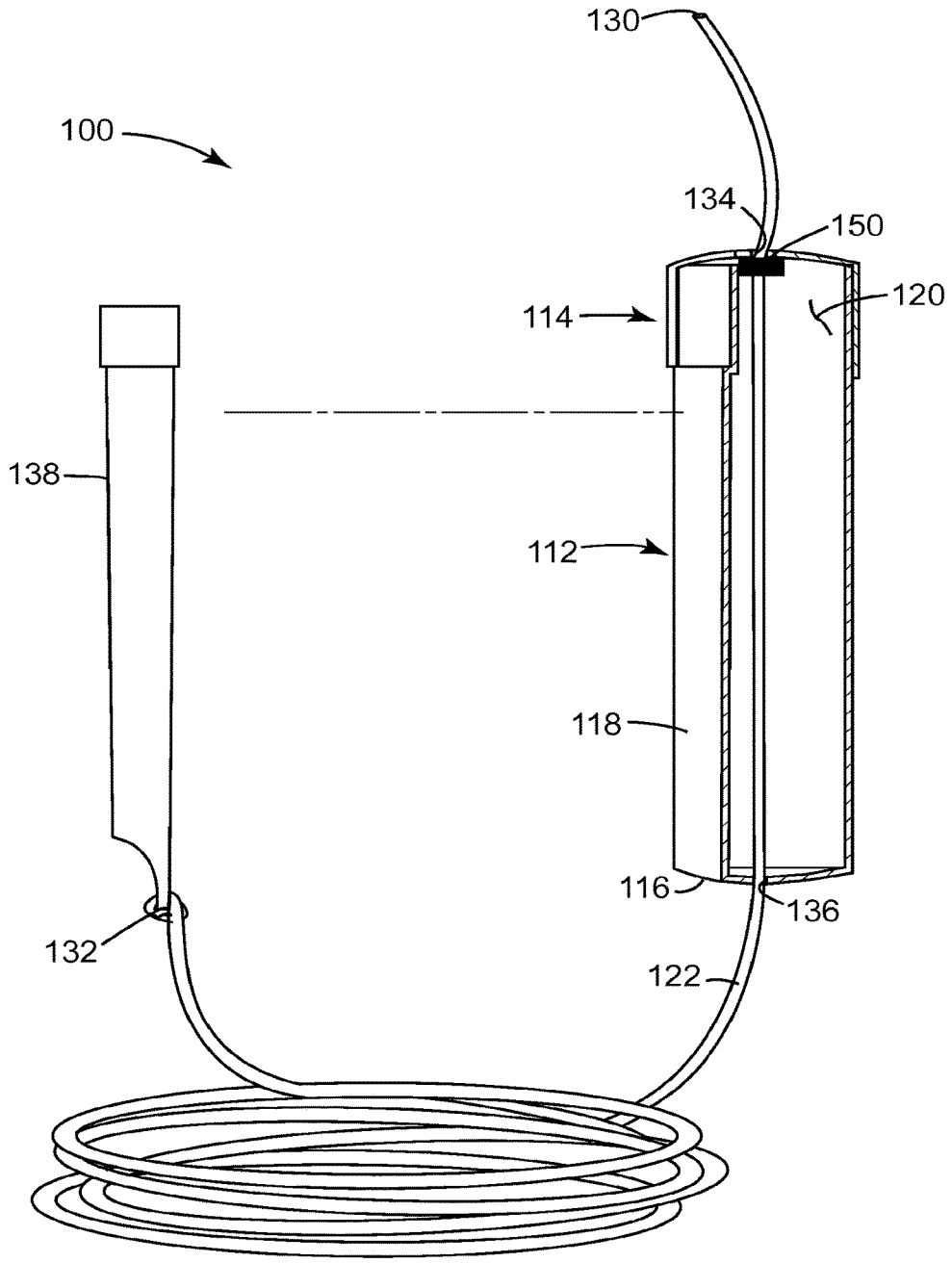
FIG. 16 is an exemplary embodiment of a cutaway, perspective view of the dual output paracord dispenser of FIG. 8.

Referring to FIG. 16, the preferred embodiment is to use one length of paracord 122 extending through both through-holes 134, 136 in order to reduce cost, complexity and assembly time. However, with one paracord length being deployed from two though-hole outputs 134, 136, there is the potential issue of using up all of the paracord 122 for general purpose applications through the first through-hole 134 and not having enough paracord 122 left to deploy the Buzz-Saw signaling technique when needed through the second through-hole 136.

In order to prevent this issue from occurring, a stop device 150 can be fastened to the paracord 122 at a proper location on the paracord. The stop device 150 can be any solid object (such as a washer, nut or sphere) fastened solely to the paracord or even just a properly tied knot in the paracord 122 itself. Alternatively, the stop device can also be rigidly anchored to the inner chamber 120 of the dispenser 100. If the stop device 150 is not anchored to the inner chamber 120, then the stop device must be sized to prevent any further dispensing of paracord 122 through the first through-hole 134 once the stop device 150 is engaged with the first through-hole 134. Simply put, the stop device 150 must be enough larger than the through-hole 134 so that it cannot be pulled through the through-hole 134.

Additionally, the stop device 150 must be positioned on the paracord 122 to allow a sufficient length of paracord 122 to be dispensed through the second through-hole 136 to provide a Buzz-Saw signal even when the stop device 150 is engaged with the first through-hole 134. For example, if it is determined that a three foot length of paracord 122 should be dedicated to the Buzz-Saw signaling technique, than the stop device 150 should be affixed to the paracord 122 at least three feet from the second end 132 which is attached to the chemical light 138. That way, when the stop device 150 is pulled up against the first through-hole 134 or anchored to the inner chamber 120 to prevent any further use for general purpose applications, there will still be about 3 feet of paracord 122 left for the Buzz-Saw signaling technique.

Figure 17:
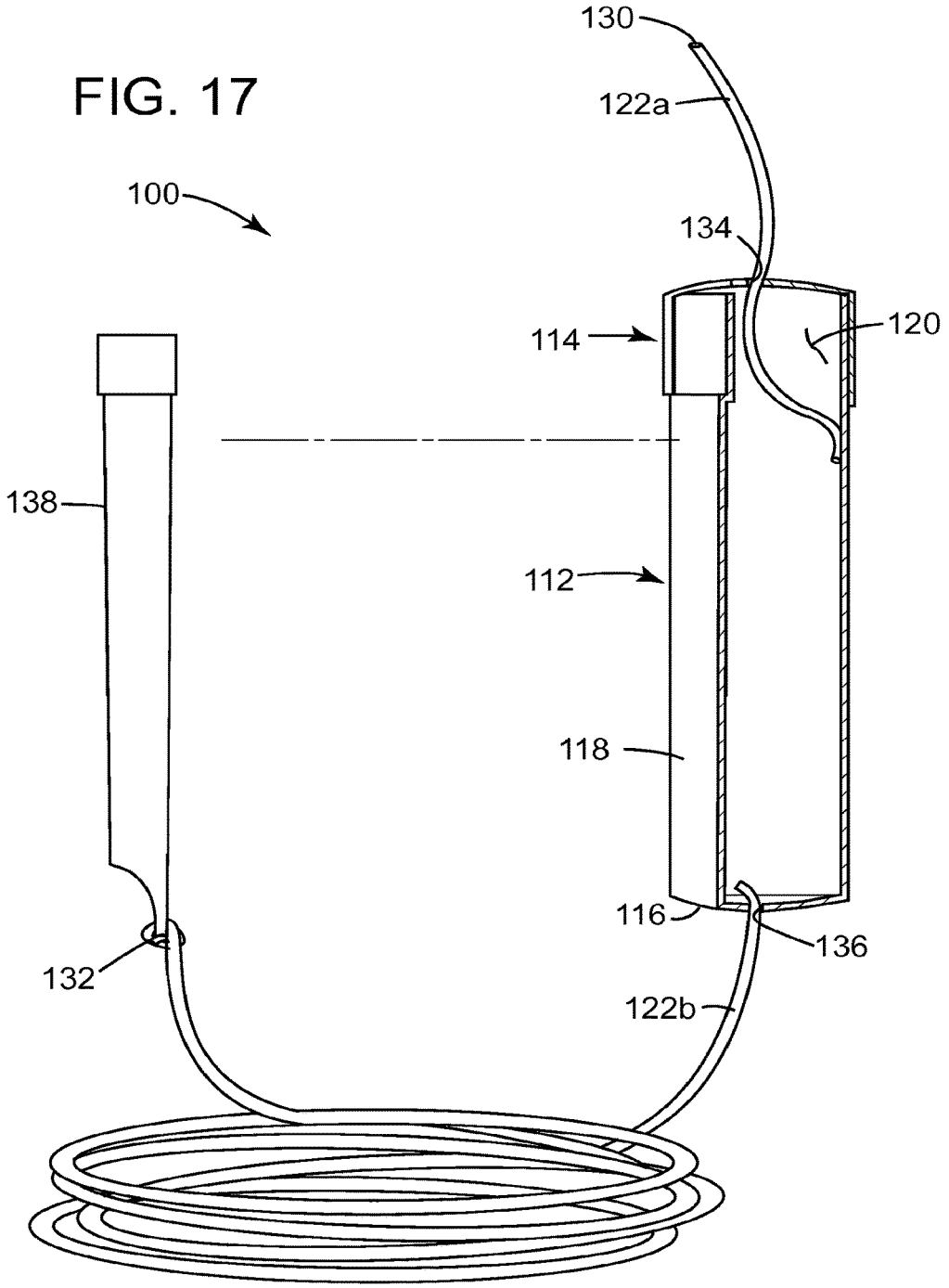
FIG. 17 is another exemplary embodiment of a cutaway, perspective view of the dual output paracord dispenser of FIG. 8.

Referring to FIG. 17, it should be noted, that if two separate lengths of paracord 122*a* and 122*b* are dispensed through the two through-holes 134 and 136 of the dispenser 100, either though backstacking, spooling or the like, than the stop device 150 will not be required. This is because the first length of paracord 122*a*, dispensed through first through-hole 134, will be dedicated to general purpose applications and can be entirely used up without interfering with the second length of paracord 122*b*. The second length of paracord 122*b*, dispensed through second through-hole 136, will be dedicated solely to the Buzz-Saw signaling technique.

Though the embodiments described herein exemplify paracord dispensers, one skilled in the art would recognize the other types of cord can also be utilized and dispensed with the present invention. For example, other types of cord may include: nylon cord, any type of thin rope, yarn, flexible stranded material or the like.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

The invention claimed is:

1. A cord dispenser comprising:

a body having an inner chamber, a closed bottom and a body sidewall connected to the bottom and extending upward from the bottom, the inner chamber operable to contain a length of cord, the length of cord having a first cord end;

a chemical light retaining mechanism rigidly affixed to the body of the dispenser, the retaining mechanism including a tapered channel integrally formed into the body sidewall and extending longitudinally upward from a bottom portion of the body sidewall and along the body sidewall, the channel configured to receive, removably secure and protect a chemical light from inadvertent activation during handling of the cord dispenser; and a first through-hole through which the first cord end is operable to be extended and securely attached to the chemical light;

wherein the chemical light can be removed from the retaining mechanism and used with the length of cord to provide a Buzz-Saw signal.

2. The cord dispenser of claim 1 comprising a second through-hole disposed in the body through which a second cord end of the cord is operable to be extended and used in any general purpose application.

3. The cord dispenser of claim 2 comprising:

a closed top, wherein the first through-hole is disposed; and a closed bottom wherein the second through-hole is disposed.

4. The cord dispenser of claim 1 comprising a cutting device attached to the body sidewall, the cutting device operable to cut a desired length of the cord.

5. The cord dispenser of claim 1, wherein the channel extends for more than half a length of the chemical light.

6. The cord dispenser of claim 1 wherein the cord is a paracord.

* * * * *